US007663038B2

(12) United States Patent
Stadler

(10) Patent No.: US 7,663,038 B2
(45) Date of Patent: Feb. 16, 2010

(54) INTEGRAL SADDLE AND BRIDGE FOR STRINGED MUSICAL INSTRUMENTS

(75) Inventor: Thomas M. Stadler, 9518 Steimie Rd., Eau Claire, MI (US) 49111

(73) Assignee: Thomas M. Stadler, Hendersonville, TN (US)

( * ) Notice: Subject to any disclaimer, the term of this patent is extended or adjusted under 35 U.S.C. 154(b) by 0 days.

(21) Appl. No.: 12/031,476

(22) Filed: Feb. 14, 2008

(65) Prior Publication Data

US 2009/0205477 A1 Aug. 20, 2009

(51) Int. Cl.
*G10D 3/04* (2006.01)

(52) U.S. Cl. ..... 84/307

(58) Field of Classification Search ..... 84/312 R, 84/305, 307, 313, 298, 299
See application file for complete search history.

(56) References Cited

U.S. PATENT DOCUMENTS 2,573,254 A 10/1951 Fender
2,714,326 A 8/1955 McCarty
2,737,842 A 3/1956 Polfus
2,740,313 A 4/1956 McCarty
2,741,146 A 4/1956 Fender
4,069,733 A 1/1978 Quan
4,768,414 A 9/1988 Wheelwright
5,227,571 A * 7/1993 Cipriani ..... 84/307
6,677,514 B2 1/2004 Fishman
7,301,086 B2 11/2007 Ito
2006/0243121 A1 * 11/2006 Takabayashi ..... 84/731

OTHER PUBLICATIONS

Stewart-MacDonald, Catalog, until Mar. 2008, pp. 58-66, #114 Athens, Ohio.

* cited by examiner

*Primary Examiner*—Kimberly R Lockett

(57) ABSTRACT

An integral saddle and bridge for stringed musical instruments, such as the electric guitar, having a bridge piece comprised of a bar with a slot formed in the top to receive a saddle piece. By pressure or adhesive the bridge and saddle are made solid and therefore, and by their materials, acoustically superior. The bridge is formed to mate with common mountings and the saddle is carved to achieve intonation.

1 Claim, 3 Drawing Sheets

INTEGRAL SADDLE AND BRIDGE FOR STRINGED MUSICAL INSTRUMENTS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

This invention relates to and solves problems in the field of stringed musical instruments and the means of affixing and adjusting the strings by a bridge and tailpiece or combination of the two.

Strings are typically attached to the head of the instrument by a tuning mechanism providing the means to adjust the tension and musical pitch of that string. At the other end, contact with the body by the string is by a bridge and tailpiece, or a combination bridge/tailpiece. The bridge usually has a mechanical means of varying the length of the strings, or built into its geometry will be a shape giving each string a predetermined length, or compensation (intonation).

Compensation is an accounting of several phenomena causing the tension and pitch of strings to rise or "sharpen":

1. The string has a stiffness related to the elasticity of the material, manner of construction, and cross-sectional diameter. This stiffness makes the vibrating length of the string shorter than the distance separating the two points contacting the string. The stiffness impedes vibration near a point of contact.
2. The bridge holds the string at a distance above the fingerboard or fretboard to provide a clearance for the vibrating string and to accommodate a musician's hand strength and desired feel, hence the term "action" used to describe string height. Depressing a string to contact a fingerboard or fretboard is known in music as making a "stop". Because the string must be deformed from a straight line in its unstopped state to an obtuse angle with its vertex at the stop, a musician lengthens the string in making a stop. This lengthening strain causes the tension to rise, along with the musical pitch going sharp.
3. A string put into vigorous vibration describes a wider arc than one receiving less actuating energy, and makes that wider arc by stretching, again causing a sharpening of the musical pitch. Many musicians have a distinctive touch when attacking a note; they often favor a particular range of energy.

These sharpening effects require that strings be longer than mathematical theories of musical scales would indicate. Each effect has a wide range in the real world and in the bridge lays the opportunity to offer a degree of adjustment that can keep any musician and any string in tune. There are many bridges that provide a plurality of saddles and pluralities of mechanisms for their adjustment (Quan U.S. Pat. No. 4,069,773). Along with the individually adjustable saddles, modern bridges are mounted to the body with a plurality of mechanical fasteners. These bridge's many parts offer a poorer transmission of acoustical waves, squandering and muddying musical timbre.

Musical instrument bridges do not only establish a string length. They are also the primary pathways for acoustical energy from the string to the instrument's body. The materials and construction of a bridge can be heard in the instrument's voice, or "timbre" that the bridge is attached to. The best sounding bridges are those made of as few pieces possible utilizing the best materials (generally the best materials for transmission of sound are lightweight and hard). Because these bridges are solid, they also offer no further adjustment than that built into the geometry of the bridge. The bridge depicted in U.S. Pat. No. 2,714,326 is the archetypical design of prior art, and while the intonation is not adjustable it is one of the most pure sounding bridges possible.

The acoustic guitar usually has a hardwood bridge glued to the front of the body with a slot cut into it. In that slot is placed a sliver of bone, ivory, plastic or similar natural or artificial material as the saddle, often underneath said saddle is placed a transducer for converting the mechanical vibration originated by the strings to an electrical vibration (U.S. Pat. No. 6,677,514.) The saddle is usually thick enough to be angled and carved in a way to positively affect a string's intonation, and, to a degree limited by the bridge, adjusted for action. There is a body of prior art (U.S. Pat. No. 4,768,414) dedicated to bringing individually adjustable saddles to the slotted acoustic guitar bridge.

BRIEF SUMMARY OF THE INVENTION

I have built and tested a bridge greatly improving on previous designs. This bridge fuses the idea of the slotted acoustic guitar bridge with the modern electric guitar bridge. It comprises of a bar with a slot let into the top to receive a saddle of bone, ivory, plastic, or other natural or artificial material. Coupled by slip fit, press fit, downward string pressure, or any type of adhesive, the bridge and saddle become integral and offer a full range of adjustment by carving of the saddle and adjustment of the mounting fasteners. This integral bridge and saddle has the advantage of being easy to shape and machine so as to be retrofitted to most typical bridge mountings, thus enabling complete intonation and superior instrument timbre.

DETAILED DESCRIPTION OF THE INVENTION

Figure 10:
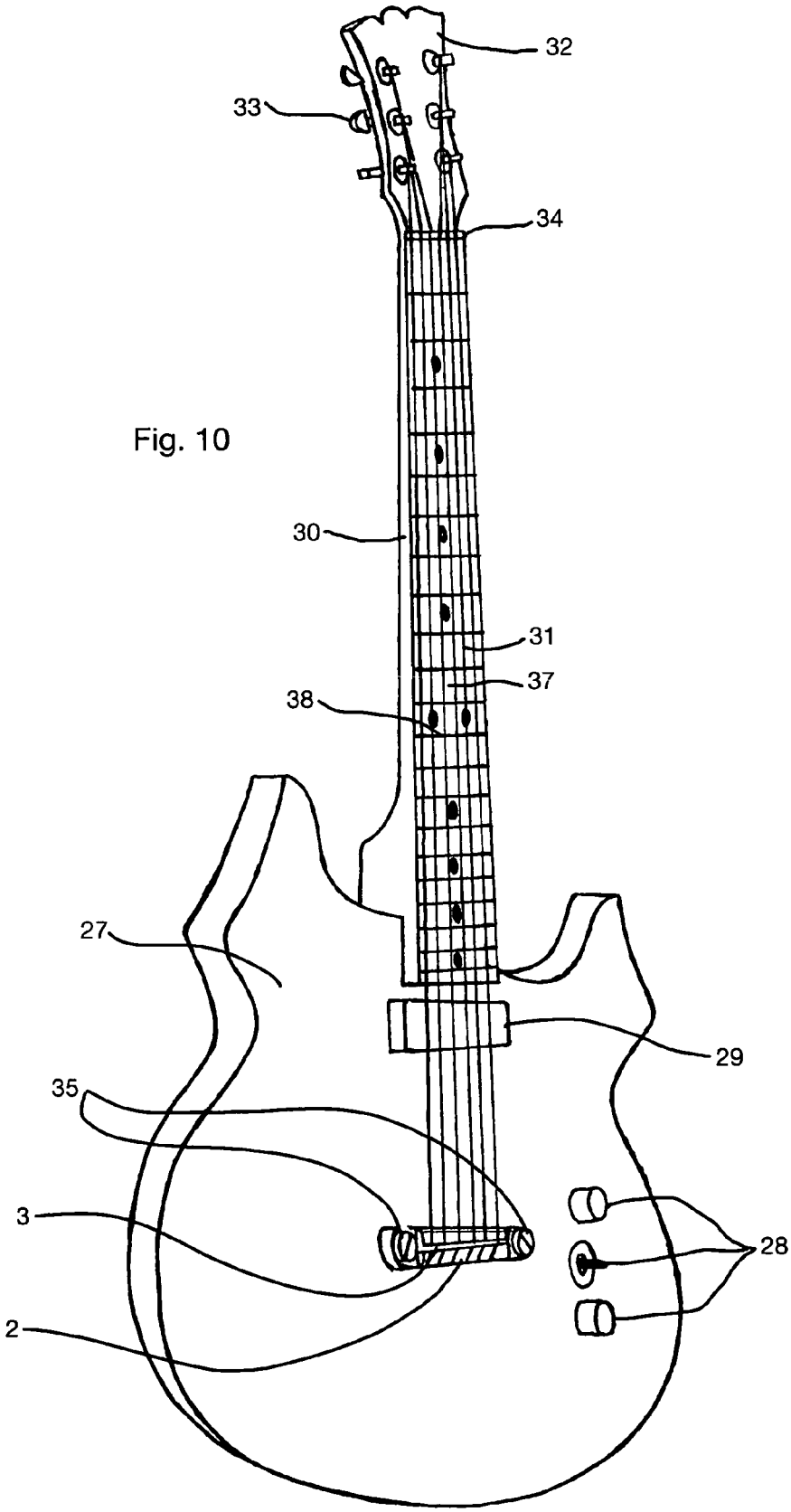
FIG. 10 is a perspective view of an electric guitar with the preferred embodiment of the bridge and saddle mounted by two stud screws.

The description of this invention details the preferred embodiment of a bridge for stringed musical instruments. For example, FIG. 10 shows an electric guitar with the bridge 2 and saddle 3 mounted to the guitar body 27 by two mounting studs 35. Also typically mounted on the body of the guitar are the pickup 29 and associated electronic controls 28.

Figure 1:
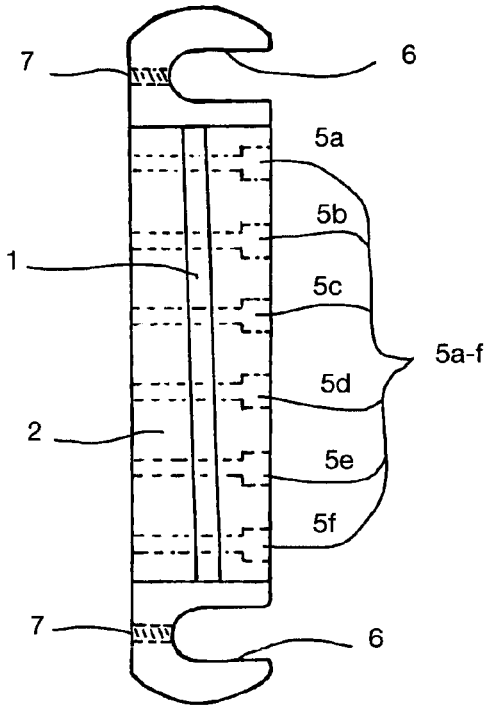
FIG. 1 is a top view of the bridge in its preferred embodiment.
Figure 2:
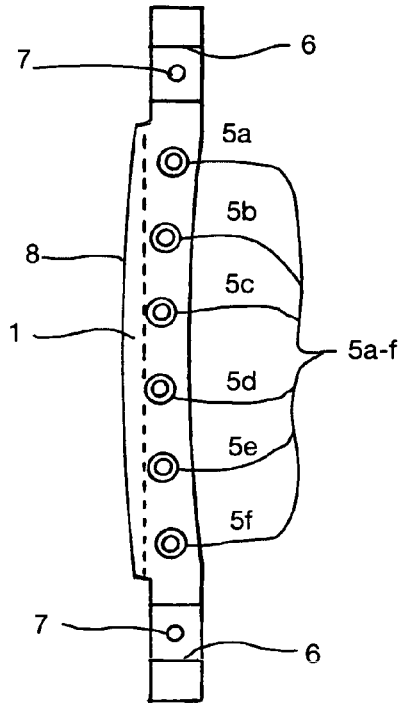
FIG. 2 is a frontal view of the bridge in the preferred embodiment.
Figure 3:
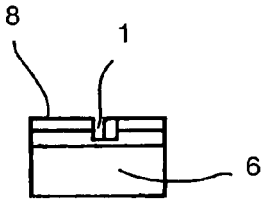
FIG. 3 is a side view of the bridge in the preferred embodiment.

A bar made of cast or machined metal (Aluminum is preferred for tone) or fiber/plastic composite becomes the bridge seen in FIGS. 1 & 2 and has a slot 1 formed into its top surface 8 which is curved to match the curvature of the fingerboard 37 FIG. 10. Into that slot is inlayed a sliver of bone 3, FIG. 4A, ivory, plastic, or other man-made or natural material. Bone is preferred for tone. The saddle is slip-fit and held in place by string pressure or by press-fit or an adhesive, such as hide glue.

Figure 4A:
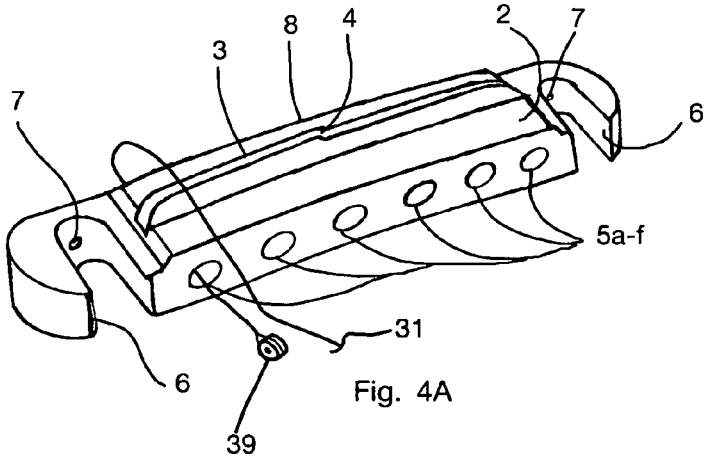
FIG. 4A is a perspective view of the assembled bridge and saddle in the preferred embodiment.
Figure 4B:
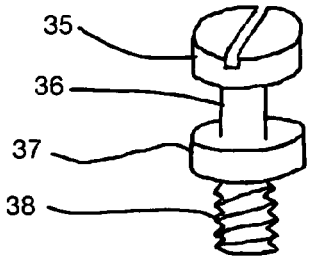
FIG. 4B is a perspective view of the type of screw stud used to attach the preferred embodiment of the bridge to the instrument body.

The bridge (FIG. 1) has two hooks 6 designed to fit around the stud post 36 seen in FIG. 4B and two set screws 7 which determine how deeply into the hooks the posts sit. The stud has a typically slotted head 35 post 36 collar 37 and thread 38 for screwing into the guitar body 27. The head and collar are spaced to allow the hook to fit between them, and the bridge to be pulled against the stud post by the tension of the guitar strings 31, FIG. 10. In FIG. 4A can be seen the countersunk holes 5*a-f* that let the strings be passed through the front of the bridge and retain the string's ball end 39. The string is wrapped over the top of the bridge and rests on the saddle 3 and continues past the neck 30 to the nut 34, headstock 32 and tuning machines 33, FIG. 10.

Intonating this bridge follows these steps:

1. Place the bridge 2 on the instrument body 27 by fitting the hooks 6 between the stud heads 35 and collars 37 and against the post 36.
2. Thread the strings 31 from the direction of the neck 30 through the bridge's string holes 5*a-f* and seat the balls 39.
3. Wrap the strings over the bridge and saddle, feed them into the tuners 33 on the headstock 32, and tighten the strings until they secure the bridge to the posts and lay the strings down on to the saddle and nut 34.
4. Adjust the action of the strings by turning the head of the studs and therefore raising or lowering the bridge.
5. Tune the instrument. In each of the following steps the instrument must be tuned every time any part has been moved.
6. Measure the pitch of each open (or unstopped) string and their corresponding tone when stopped at the octave position 38.
7. Using the set screws 7 adjust the bridge in a direction parallel to the strings until two strings have an octave tone exactly matching that of the same string open and all other strings have octaves higher in pitch (or sharp) than their corresponding open tone.
8. The saddle should then have material removed from its front edge where crossed by a sharp string until the octave tone and open tone match. Each locality of a string should be thusly intonated individually.

Figure 5:
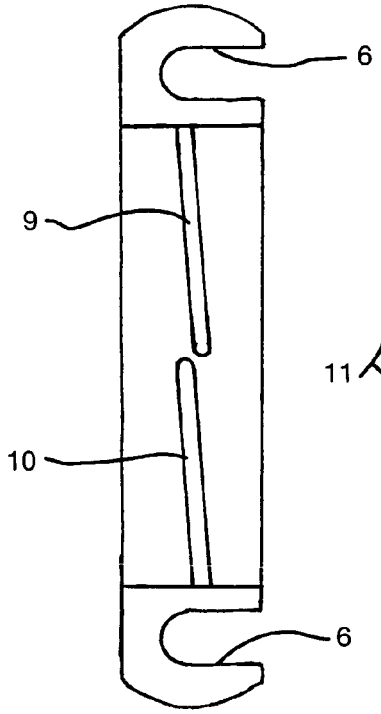
FIG. 5 is a top view of an alternate saddle slot shape.
Figure 6:
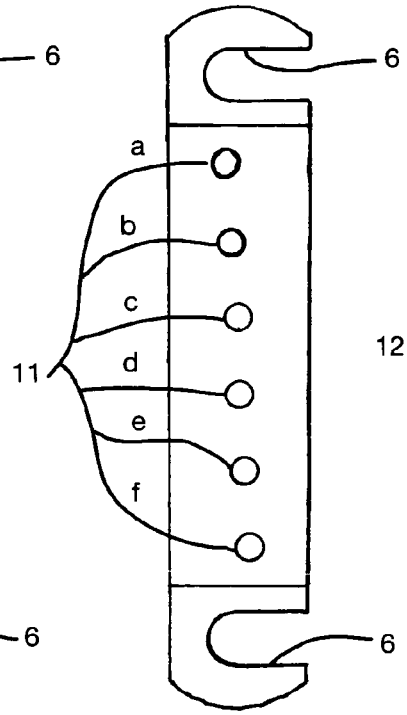
FIG. 6 is a top view of an alternate saddle recess shape comprised of a plurality of cylindrical depressions.
Figure 7:
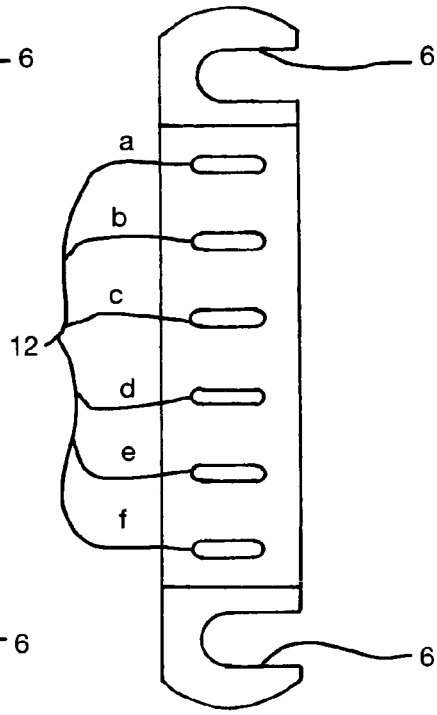
FIG. 7 is a top view of an alternate saddle recess shape comprised of a plurality of oblong slots.

Depicted in FIGS. 5, 6, 7 are three alternate saddle patterns based on the preferred embodiment of a single slot. FIG. 5 has a split slot 9, 10 to approximate a saddle intonation typical of guitars with three plain strings and three thicker wrapped strings. FIG. 6 shows an easy to machine pattern of six drilled holes 11*a-f* that would receive dowels of saddle material, rather than a strip, or sliver. In FIG. 7 are six oblong slots 12*a-f* formed in a direction parallel to the strings. This pattern offers a wider range of intonation for guitars with studs incorrectly mounted so as to be beyond the physical limits of adjustment the hooks 6 and set screws 7.

Figure 8:
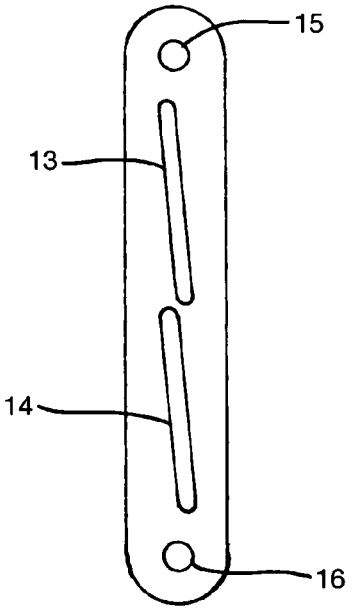
FIG. 8 is a top view of an alternate saddle slot shape and an alternate mounting pattern.

Depicted in FIG. 8 is an alternate bridge with two slots 13, 14 and two mounting screw holes 15, 16. This type of bridge does not hook on to posts, but rather sits over posts captivating its motion parallel to the strings and requires a separate tailpiece.

Figure 9:
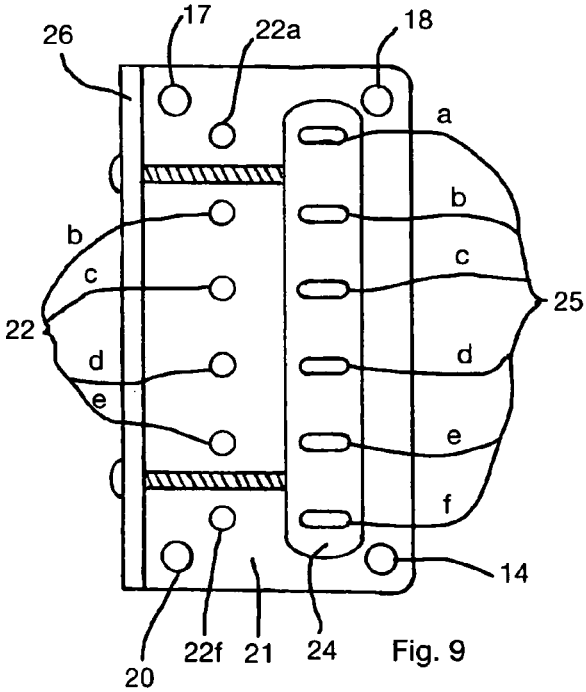
FIG. 9 is a top view of an alternate saddle slot pattern and an alternate mounting showing two mounting screws and a base plate.

Depicted in FIG. 9 is a bridge 24 with six oblong saddles 25*a-f* mounted and kept in place by two adjustment screws 23 that hang on the lip 26 of a base plate 21. The base plate is screwed to the body of a guitar or a tremolo mechanism through holes 17-20 and strings are brought from below though holes 22*a-f* and wrapped over the bridge.

I claim the following:

1. An integral bridge and saddle for stringed musical instruments comprised of a bar of metal or man-made composite with a slot formed into the top surface of it to allow a saddle or plurality of saddles to be solidly inlayed by pressure, press-fit or adhesives, said bridge having also, a set of recesses to secure the strings and ends terminating in books.

* * * * *